United States Patent [19]

Hart

[11] 4,372,107

[45] Feb. 8, 1983

[54] FALSE TWIST DEVICE

[75] Inventor: Douglas G. Hart, Greenville, S.C.

[73] Assignee: High-Speed Spinning, Inc., Greenville, S.C.

[21] Appl. No.: 217,570

[22] Filed: Dec. 17, 1980

[51] Int. Cl.[3] ..... D01H 7/92; D02G 1/04

[52] U.S. Cl. ..... 57/346; 57/344

[58] Field of Search ..... 57/331, 332, 334, 341, 57/343, 344, 346, 347, 348

[56] References Cited

U.S. PATENT DOCUMENTS

| | | | |
|---|---|---|---|
| 2,619,790 | 12/1952 | Hardacre et al. | 57/343 |
| 2,655,781 | 10/1953 | Heberlein et al. | 57/346 |
| 2,866,311 | 12/1958 | Schrenk | 57/346 |
| 3,114,231 | 12/1963 | Selling et al. | 57/331 |
| 3,241,304 | 3/1966 | Mattingly | 57/346 X |
| 3,292,357 | 12/1966 | Richter | 57/346 |
| 3,624,998 | 12/1971 | MacKie | 57/343 X |
| 3,847,190 | 11/1974 | Forester | 57/346 X |
| 3,950,930 | 4/1976 | Shindo et al. | 57/346 X |

*Primary Examiner*—Donald Watkins

[57] ABSTRACT

An apparatus for inserting a false twist in roving or yarn as the strand or strands of fibers are fed from between a pair of front rolls to a takeup device. The apparatus includes a rotor rotatably carried in an enclosing casing. A plurality of circumferentially spaced air entrapping members is provided in the perimeter of the rotor so that upon applying pressurized air to the members, the rotor is driven. A yarn conveying tube extends axially through the rotor and is fixed thereto for being rotated therewith. A portion of the yarn conveying tube is radially disposed from the rotational axis of the rotor so that as the yarn flows through the rotating tube, a false twist is inserted in the yarn from the tube up to the nip of the front rolls.

8 Claims, 7 Drawing Figures

FALSE TWIST DEVICE

BACKGROUND OF THE INVENTION

This invention relates to a roving, spinning or twisting machine, wherein a false twist is imparted, by a rotating tubular member, to the strand of fibers emerging from the front roll nip.

Generally, in the textile industry, long strands of roving or yarn are wound on roving, spinning, or twisting machines on bobbins to form packages which are subsequently used in the construction of fabrics. One of the problems limiting the use of higher machine speeds in these processes is that of developing more torque in the strand of fibers emerging from the front nip of the front rolls. For example, in roving, it frequently happens that instead of the twist being continuously propagated up to the front roll nip—or within ¼ inch thereof—the strand of fibers is virtually untwisted from ¼ inch to as much as 1 inch below the front roll nip. As a result, a higher frequency of end breaks occurs. The same effect on a much reduced scale occurs in ring twisting.

One attempt to insert a false twist in yarn using a false twisting device is illustrated in U.S. Pat. No. 3,114,231 granted on Dec. 17, 1963. In U.S. Pat. No. 614,834 granted on Nov. 29, 1898, there is illustrated a spinning machine wherein the yarn is fed through a tubular member. The tubular member is, in turn, rotated by belts. Positioned on top of the tubular member is a tapering upper portion D3 which intermittently engages the thread and stretches it.

In U.S. Pat. No. 1,126,042, there is disclosed another spinning device which includes a tubular member. It is noted in FIG. 1 that the yarn exits from the tubular member as shown in FIG. 1 and re-enters the tubular member. In all the devices disclosed above, there is an external mechanical coupling such as through belts that drive the tubular members.

SUMMARY OF THE INVENTION

The invention relates to a device for imparting a false twist to a strand of fibers such as roving, yarn, etc. as the strand of fibers is fed therethrough. Normally, the strand of fibers is fed between a pair of driven front rolls and is taken up on a takeup device such as a rotating bobbin. In order to place a false twist in the yarn or strand of fibers, the yarn is fed through a pneumatically driven turbine. The turbine includes a rotor which is rotatably carried in an enclosing casing. The rotor has a circular rim defined by an outer pheriphery and rotates about an axis. A plurality of circumferentially spaced air entrapping members is provided in the perimeter of the rotor. A strand conveying tube extends axially through the casing and the rotor and is fixed to the rotor for rotation therewith. A portion of the strand conveying tube is radially disposed from the rotational axis of the rotor. The strand extends from between the pair of front rolls through the strand conveying tube to the takeup device. Pressurized air is directed into the buckets provided on the rotor causing the rotor to be rotated for imparting a false twist to the strand of fiber as it is fed therethrough.

In one particular embodiment, an upper portion of the strand conveying tube is in axial alignment with the rotor then has a portion that assumes an arcuate semicircular configuration which is radially displaced from the axis and then terminates in a portion that is in axial alignment with the rotor.

In another embodiment, an upper entrance of the yarn conveying tube is radially displaced from the axis of the rotor and the tube extends radially inwardly from the entrance to a point where it is in axial alignment with the rotor.

In still another embodiment of the invention, a strand conveying tube has a circular loop provided between its ends with the axis of the loop being perpendicular to the axis of the rotor. In all of the above embodiments, the inner surface of the tube is smooth and can be constructed of any suitable smooth material such as glass or polished stainless steel.

During the processes of roving, spinning or twisting, a false twist is imparted in the strand of yarn extending from the turbine up to the nip of the strand delivery rolls.

In still another embodiment, an electric motor is used for driving the strand conveying tube. The strand conveying tube extends through and along the axis of the rotor of the electric motor.

Accordingly, it is an important object of the present invention to provide a twister for imparting a false twist to strands of yarn as the yarn is fed from the front rolls to a takeup device with the twist extending upwardly from the twister to the front roll nip.

Another important object of the present invention is to provide a simple and reliable device for imparting false twist to strands of fibers.

Still another important object of the present invention is to provide an air turbine in combination with an offset tube for imparting a false twist in a strand of fibers.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
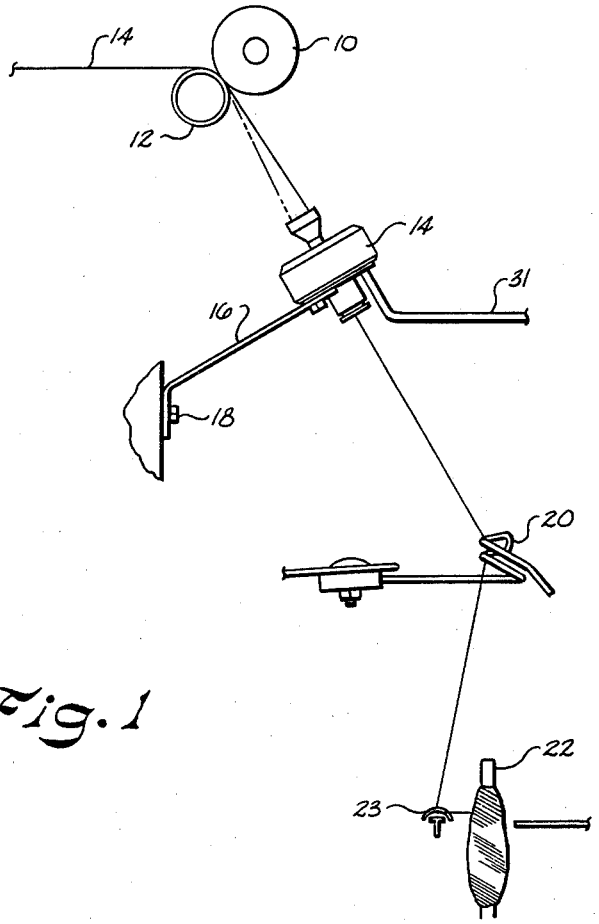
FIG. 1 is a side elevational view illustrating an apparatus constructed in accordance with the present invention for imparting twist in strands flowing between front rolls and a takeup package.

Referring now to FIG. 1 of the drawings, there is illustrated in side elevation a spinning machine upon which a twister constructed in accordance with the present invention is utilized. It is to be understood, however, that the twister could be utilized on roving, spinning and twisting machines, and the spinning machine shown in FIG. 1 is for purposes of illustration only.

The spinning machine includes a pair of driven front rolls 10 and 12 through which strands of fibers 14 pass. The strands of fibers are fed between the front rolls 10 and 12 to a twister 14. The twister, in turn, is mounted on the side of the spinning machine by any suitable means such as by a bracket 16 and a bolt 18. After the yarn exits from the twister 14, it then passes through a conventional pig-tail 20 and lappet assembly; or on some, the lappet and pig-tail are eliminated. The pig-tail 20 is in the position that it would assume at the start of building the yarn on a bobbin 22. The bobbin 22 is equipped with the conventional traveler 23 which causes a true twist to build up the yarn from the bobbin 22 to the twister 14. Between the twister 14 and the nip of the front rolls 10 and 12, the twister imparts a false twist in the yarn. However, it is to be understood that either a single or double roving can be fed between the front rolls 10 and 12. When a double roving is fed between the front rolls 10 and 12, it normally assumes an V-shaped configuration directly beneath the front rolls. This is generally the weak area in forming the roving, spun or twisted yarn. When end-breakage occurs, it normally occurs in this area.

The twister 14, constructed in accordance with the present invention, substantially eliminates this V-shaped configuration and imparts a false twist to the strands of fibers from adjacent the top of the twister to adjacent the nip of the feed rolls 10 and 12.

Figure 2:
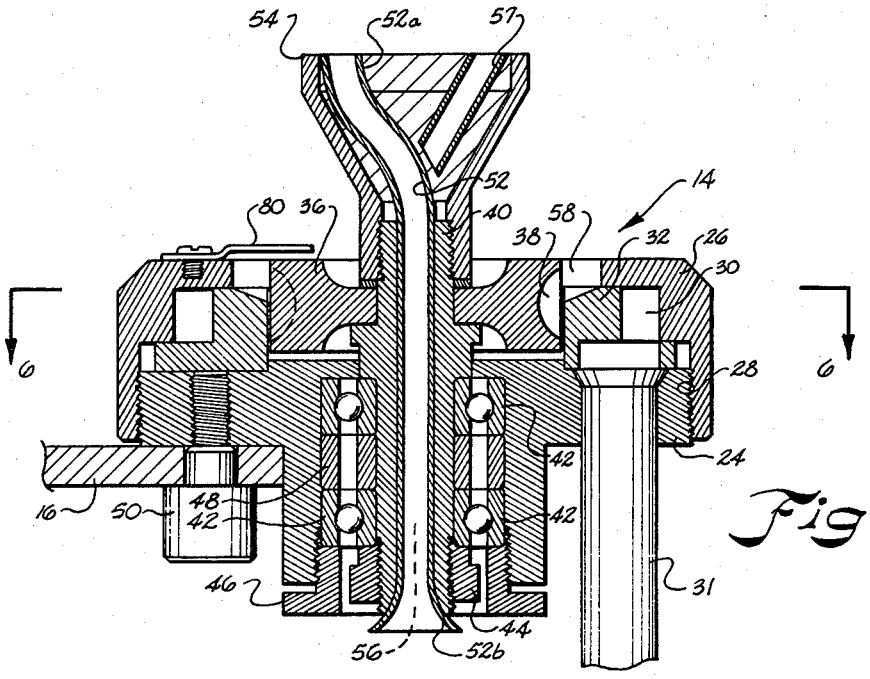
FIG. 2 is a sectional view of the pneumatically driven twister.

Referring now to FIG. 2 of the drawings, the twister is illustrated in section and includes an enclosing casing formed by a lower casing 24 and an upper casing 26 that are secured together by means of threads 28 provided in the outer wall of the lower casing and an inner wall of the upper casing. Any suitable means could be utilized for securing the lower casing to the upper casing. A circular chamber 30 is provided in the upper casing directly above the end of a tube 31 through which pressurized air is fed.

Figure 6:
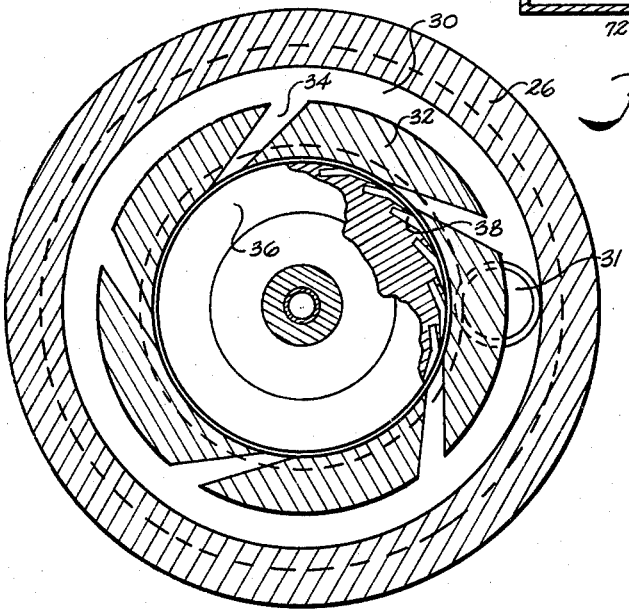
FIG. 6 is a sectional view taken along lines 6—6 of FIG. 2.

Radially disposed inwardly from the circular opening 30 is a circular nozzle plate 32 which is shown in plan view in FIG. 6. Extending through the nozzle plate 32 are nozzles 34 which assume a converging conical-shaped configuration. The nozzles 34 terminate closely adjacent the periphery of a rotor 36. Air entrapping members 38 in the form of buckets are provided in the periphery of rotor 36, or they may take the form of vanes. The gas engine disclosed in FIGS. 2 and 6 can assume other configurations, and one suitable gas engine is disclosed in U.S. Pat. No. 4,150,918 granted to James V. Theis, Jr. on Apr. 24, 1979.

The rotor 36 is fixed to a vertically extending tubular member 40 that extends through both the upper and lower casings 26 and 24. The tubular member 40 is, in turn, supported on suitable bearings such ball bearings 42, plain journal bearings or gas bearings. A lock nut 44 is threadably carried on the bottom of the tubular member 40 for securing the tubular member 40 within the casing. A collar 46 is threaded in the bottom of the lower casing for securing the bearings in place. Interposed between the two sets of bearings 42 are spacers 48. A bolt 50 extends through the bracket 16 and into the lower casing for securing the twister to the bracket 16.

A strand conveying tube 52 is carried within the tubular member 40 and is fixed thereto by any suitable means such as a press fitting so as to rotate with the tubular member 40 and the rotor 36. A cylindrical member 54 is threadably secured to the top of the tubular member 40. An upper portion 52*a* of the strand conveying tube is provided in the cylindrical member and is bent in a curving path radially from the axis of rotation 56 of the rotor. The strand conveying tube 52 may be constructed of any suitable material such as stainless steel or glass. The inner wall of the strand conveying tube 52 is smooth.

A balancing tube 57 is diametrically opposed from the upper portion of the strand conveying tube 52*a* for maintaining the assembly in balance.

The remainder of the cylindrical member 54 is filled with any suitable filler material such as epoxy.

The lower end 52*b* of the strand conveying tube 52 is flared and extends slightly below the collar 46 provided on the bottom of the lower casing.

An opening 58 is provided in the upper casing 26 closely adjacent the periphery of the rotor 36 through which the pressurized gas exhausts after impacting against the air entrapping members 38 provided on the rotor.

In operation, as the strands of fibers are fed by the front rolls 10 and 12 through the upper portion 52*a* of the strand conveying tube, it engages the walls of the curved portion of the tube providing a frictional contact therebetween. As a result of the strand conveying tube rotating on one particular machine at approximately 12,000 r.p.m., this imparts a false twist to the strand of fibers between the twister 14 and the nip of the front rolls 10 and 12. The rotating speed of the conveying tube would vary from machine to machine.

Referring now to FIG. 6 of the drawings, the rotor 36, which as previously mentioned is fixed to the strand conveying tube, is driven by pressurized air flowing up through the tube 31 into the circular opening 30. The air then flows through the converging nozzles 34 and impacts against the air entrapping members 38. After striking the air entrapping members 38, the air exhausts out of the exhaust opening 58 provided in the top casing 26.

Figure 3:
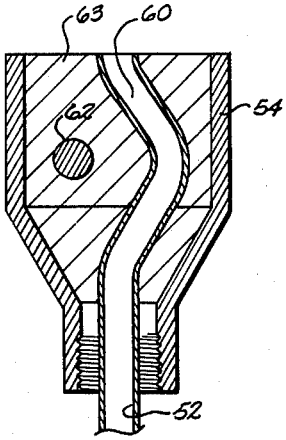
FIG. 3 is an enlarged sectional view illustrating a modified form of the tube configuration extending through the twister.

In FIG. 3, an upper portion 60 of the yarn conveying tube assumes a semi-circular configuration. As can be seen, the top of the tube is in axial alignment with the axis of the rotor with the intermediate portion being bent radially outwardly from the axis and vertically positioned above the rotor. In order to maintain the balance of the cylindrical member with the yarn conveying tube provided therein a balancing ball 62 in the form of a lead shot is provided in the cylindrical member. Epoxy 63 or any other suitable type of filler is provided in the cylindrical member for securing the tube and the balancing weight 62 therein.

Figure 4:
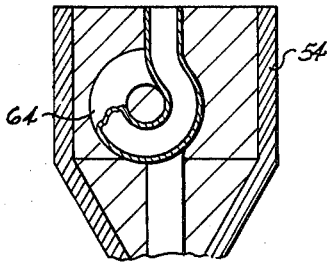
FIG. 4 is still another modified form for the tube configuration extending through the twister.

In FIG. 4, the portion 64 of the tube carried in the cylindrical member includes a loop which has an axis extending therethrough which is substantially perpendicular to the axis of rotation of the rotor.

Figure 5:
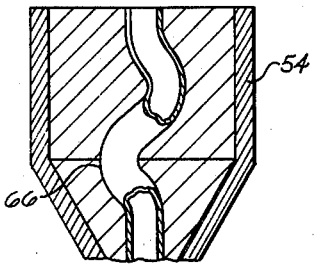
FIG. 5 is still another modified form of the invention wherein the strand conveying tube assumes a helical configuration.

In FIG. 5, a portion 66 of the yarn conveying tube extending through the cylindrical member 54 assumes a helical configuration about the axis of rotation of the rotor.

Figure 7:
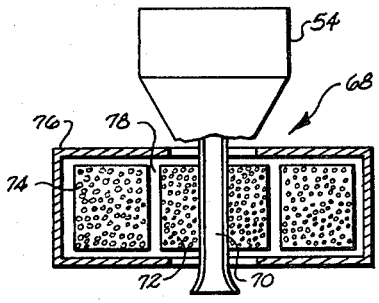
FIG. 7 is still another modified form of the invention wherein an electric motor is used for driving the strand conveying tube.

While in the preferred embodiment, the yarn conveying tube is rotated with a gas engine such as illustrated in FIGS. 2 and 6, it could also be rotated with an electric motor 68 which has an axial bore 70 extending through a rotor or armature 72. A field winding 74 surrounds the armature 72 which can be excited by any suitable source of electrical power for driving the armature 72. An air gap 78 is provided between the field winding 74 and the armature 72. The windings of the motor are enclosed in a casing 76. Any of the various yarn conveying tube configurations such as illustrated in FIGS. 2, 3, 4, and 5 be could be utilized with the electric motor driven twister of FIG. 7.

In FIG. 2, the source of power is a source of pressurized air, and the power transmission means is the nozzle plate 32. A gap is provided between the power transmission means or nozzle plate 32 and the rotor 36. The power medium which is pressurized air flows from the source through the power transmission means 32 and the air gap driving the rotor 36. In the twister shown in FIG. 7, the source of power is any suitable source of electrical energy, and the transmission means is the field winding 74. An air gap 78 is provided between the power transmission means 74 and the rotor or armature 72. A power medium in the form of magnetic flux flows through the gap 78 for driving the armature 72.

A brake 80 in the form of a depressible metal strip is provided for stopping the rotor 36 for facilitating threading the yarn through the tube 52.

While a preferred embodiment of the invention has been described using specific terms, such description is for illustrative purposes only, and it is to be understood that changes and variations may be made without departing from the spirit or scope of the following claims.

What is claimed is:

1. An apparatus for inserting a false twist in a strand of fibers as said strand is fed from between a pair of feed rolls to a takeup device, said apparatus comprising:

a casing, a rotor rotatably carried in said casing;

a plurality of circumferentially spaced air entrapping members provided on said rotor;

a strand conveying tube extending axially through said casing and said rotor and being fixed to said rotor for rotation therewith;

a portion of said strand conveying tube being radially disposed from the rotational axis of said rotor;

said strand extending from between said pair of feed rolls through said strand conveying tube to said takeup device;

an upper portion of said strand conveying tube being in axial alignment with said rotor then has an intermediate portion that assumes an arcuate semi-circular configuration which is radially displaced from said axis and vertically positioned above said rotor and then has a lower portion extending through said rotor that is in axial alignment with said rotor; and means for directing pressurized air into said air entrapping members provided on said rotor causing said rotor to be rotated whereby a false twist is imparted to said strand of fibers as said strand of fibers travels from said rolls to said takeup device.

2. An apparatus for inserting a false twist in a strand of fibers as said strand is fed from between a pair of feed rolls to a takeup device, said apparatus comprising:

a casing;

a rotor rotatably carried in said casing;

a plurality of circumferentially spaced air entrapping members provided on said rotor;

a strand conveying tube extending axially through said casing and said rotor and being fixed to said rotor for rotation therewith;

a portion of said strand conveying tube being radially disposed from the rotational axis of said rotor;

an upper entrance of said yarn conveying tube being radially displaced from the axis of said rotor and said tube extends radially inwardly from said entrance to a point where it is in axial alignment with said rotor;

said strand extending from between said pair of feed rolls through said strand conveying tube to said takeup device; and means for directing pressurized air into said air entrapping members provided on said rotor causing said rotor to be rotated whereby a false twist is imparted to said strand of fibers as said strand of fibers travels from said rolls to said takeup device.

3. An apparatus for inserting a false twist in a strand of fibers as said strand is fed from between a pair of feed rolls to a takeup device, said apparatus comprising:

a casing;

a rotor rotatably carried in said casing;

a plurality of circumferentially spaced air entrapping members provided on said rotor;

a strand conveying tube extending axially through said casing and said rotor and being fixed to said rotor for rotation therewith;

a portion of said strand conveying tube being radially disposed from the rotational axis of said rotor;

said strand extending from between said pair of feed rolls through said strand conveying tube to said takeup device;

a brake means carried by said casing engaging said rotor upon being activated for stopping said rotor while said pressurized air is being directed into said air entrapping members; and means for directing pressurized air into said air entrapping members provided on said rotor causing said rotor to be rotated whereby a false twist is imparted to said strand of fibers as said strand of fibers travels from said rolls to said takeup device.

4. An apparatus for inserting a false twist in a strand of fibers as said strand is fed from between a pair of feed rolls to a takeup device, said apparatus comprising:

a casing;

a rotor rotatably carried in said casing;

a plurality of circumferentially spaced air entrapping members provided on said rotor;

a strand conveying tube extending axially through said casing and said rotor and being fixed to said rotor for rotation therewith;

a portion of said strand conveying tube being radially disposed from the rotational axis of said rotor;

a cylindrical member carried on top of said rotor;

said radially disposed portion of said strand conveying tube extending into said cylindrical member;

a filler material carried in said cylindrical member encapsulating said radially disposed portion of said strand conveying tube;

means carried by said cylindrical member for balancing said strand conveying tube;

said strand extending from between said pair of feed rolls through said strand conveying tube to said takeup device; and means for directing pressurized air into said air entrapping members provided on said rotor causing said rotor to be rotated whereby a false twist is imparted to said strand of fibers as said strand of fibers travels from said rolls to said takeup device.

5. The apparatus as set forth in claim 1 further comprising:

said intermediate portion of said strand conveying tube assuming a helical configuration about said axis of said rotor.

6. An apparatus for inserting a false twist in a strand of fibers as said strand is fed from between a pair of feed rolls to a takeup device, said apparatus comprising:

a housing;

a rotor rotatably carried in said housing;

a strand conveying tube extending axially through said housing and said rotor and being fixed to said rotor for rotation therewith;

a portion of said strand conveying tube being radially disposed from the rotational axis of said rotor;

said radially disposed portion of said strand conveying tube being positioned between said rotor and said feed rolls;

said strand extending from between said pair of feed rolls through said strand conveying tube to said takeup device;

a source of power;

a power transmission means;

a gap provided between said power transmission means and said rotor, and a power medium flowing from said source of power through said power transmission means and said gap driving said rotor;

whereby a false twist is imparted to said strand of fibers as said strand of fibers travels from said rolls to said takeup device.

7. The apparatus as set forth in claim 6 further comprising:

said power transmission means is an air nozzle, and said source of power is pressurized air.

8. The apparatus as set forth in claim 6 further comprising:

said power transmission means is an electrical winding, and said source of power is an electrical power source.

* * * * *